United States Patent [19]

Blossey et al.

[11] 4,256,818

[45] Mar. 17, 1981

[54] MAGNETIC OR ELECTROSTATOGRAPHIC IMAGING AND HIGH SPEED FUSING METHOD USES POLYAMIDE RESIN IN TONER

[75] Inventors: Daniel F. Blossey, Penfield; Peter F. Erhardt, Webster; Charles G. Dickerson, Farmington; Donald S. Sypula, Fairport, all of N.Y.; James E. Kuder, Fanwood, N.J.; J. Kirk Swigert, Penfield, N.Y.

[73] Assignee: Xerox Corporation, Stamford, Conn.

[21] Appl. No.: 91,295

[22] Filed: Nov. 5, 1979

[51] Int. Cl.[3] ..... G03G 11/00; G03G 19/00

[52] U.S. Cl. ..... 430/39; 430/120; 430/122; 430/126; 430/124; 252/62.54; 252/62.56; 260/42.22; 260/DIG. 38; 430/109

[58] Field of Search ..... 430/39, 120, 121, 122, 430/124, 107, 108, 126; 252/62.54, 62.56; 260/37 N, 42.22, DIG. 38

[56] References Cited

U.S. PATENT DOCUMENTS

| | | | |
|---|---|---|---|
| T875,005 | 6/1970 | Beyer | 430/109 |
| 2,826,634 | 3/1958 | Atkinson et al. | 178/6.6 |
| 3,185,777 | 5/1965 | Rheinfrank | 430/126 |
| 3,221,315 | 11/1965 | Brown | 340/174.1 |
| 3,345,294 | 10/1967 | Cooper | 430/122 |
| 3,377,286 | 4/1968 | Stricklin | 430/107 X |
| 3,520,811 | 7/1970 | Swoboda | 252/62.54 |
| 3,627,682 | 12/1971 | Halt, Jr. | 252/62.54 |
| 3,900,588 | 8/1975 | Fisher | 427/19 |
| 3,901,695 | 8/1975 | Shelffo | 430/120 X |
| 3,933,665 | 1/1976 | Van Engeland | 430/110 X |
| 4,031,021 | 6/1977 | Deming | 430/107 |
| 4,035,810 | 7/1977 | Blossey | 346/74.1 |
| 4,099,968 | 7/1978 | Scouten | 430/120 X |
| 4,100,087 | 7/1978 | Takayama et al. | 252/62.53 X |
| 4,108,786 | 8/1978 | Takayama et al. | 252/62.53 X |
| 4,137,188 | 1/1979 | Uetake et al. | 430/111 |
| 4,176,078 | 11/1979 | Lu | 430/109 |

*Primary Examiner*—John D. Welsh

*Attorney, Agent, or Firm*—H. M. Brownrout; P. H. Kondo; E. O. Palazzo

[57] ABSTRACT

This invention is directed to new electrophotographic, and magnetic toners, which are useful for example in high speed fusing systems, these toners being comprised of a polyamide resin, a pigment or colorant, which pigment or colorant may be magnetic and as an optional ingredient, a carrier material. The polyamide resin is of the formula

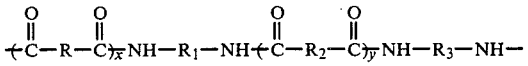

wherein R, $R_1$, $R_2$, and $R_3$ are radicals independently selected from aliphatic, substituted aliphatic, aromatic, substituted aromatic, cycloaliphatic, and heterocyclic, x is a number of from 1 to about 100, and y is a number of from 1 to about 100. In one preferred embodiment the toner composition is comprised of the polyamide resin and a high loading, 50–75 percent of a magnetic material, allowing for high speed fusing in magnetic imaging systems.

2 Claims, No Drawings

MAGNETIC OR ELECTROSTATOGRAPHIC IMAGING AND HIGH SPEED FUSING METHOD USES POLYAMIDE RESIN IN TONER

BACKGROUND OF THE INVENTION

This invention relates generally to new toners and the use of such toners for developing images. More specifically, the present invention is concerned with new toners containing polyamide resins which are useful in magnetic imaging systems, and electrophotographic imaging systems employing heat pressure fusing systems, especially high speed fusing systems as discussed hereinafter.

In the electrophotographic process, especially the xerographic process, and in magnetic imaging systems similar steps are involved in causing the formation and development of images including for example the formation of a latent image, the development of the latent image with electroscopic materials, such as toner, optionally, transferring the developed image to a suitable support such as paper, fusing the image to the paper substrate using a number of known techniques, including those employing heat, and optionally cleaning the surface from which the developed latent image has been transferred. In the xerographic process the photoconductive surface which contains an electrostatic latent image can be developed by means of a variety of pigmented resin materials specifically made for this purpose, such as toners. The toner material is electrostatically attracted to the latent image on the plate in proportion to the charge concentration thereon. These toner material can be applied by a number of known techniques including for example, cascade developement, see U.S. Pat. No. 3,618,552, magnetic brush development, see U.S. Pat. No. 2,874,063, and touchdown development, see U.S. Pat. No. 3,166,432. The developed image is then transferred to a suitable substrate such as paper and can be fixed by using a number of different techniques including for example vapor fixing, heat fixing, pressure fixing or combinations thereof as described for example in U.S. Pat. No. 3,539,161.

In magnetic imaging systems substantially the same process steps are involved as described above with respect to electrophotographic imaging systems, thus there is formed a latent magnetic image on a magnetizable recording medium, which image can be used in duplicating processes, for example, by repetitive toning, and transfer of the developed image. The latent magnetic image is formed by any suitable magnetization procedure whereby a magnetized layer of marking material is magnetized and such magnetism transferred imagewise to the magnetic substrate. The latent magnetic image can be developed with a magnetic developer to render such image visible. The developed visible magnetic image can then be typically transferred to a receiver such as for example paper, which image is fused on the paper, in order to produce a final copy or print referred to in the art as a hard copy. There are a number of known techniques for creating the latent image which are described for example in U.S. Pat. Nos. 4,032,923; 4,060,811; 4,074,276; 4,030,105; 4,035,810; 4,101,904; and 4,121,261, the teachings of these patents being completely incorporated herein by reference.

One method of developing magnetic images is referred to as magnetic toner touchdown developement, which involves providing a substantially uniform layer of toner comprising magnetic material on a conductive substrate, which material can be brought either closely adjacent to that of the image or in contact with the image. The magnetic material in the toner acts as an extension of the conductive backing and therefore acquires charge, induced therein by the latent image of a polarity opposite to that in the latent image. The conductive substrate can be biased to assist in transfer of the toner to the latent image, however, a conductive backing is not essential.

Typical suitable fusing methods that may be used have been described in the prior art and include for example, heating the developed image (toner) to cause the resins thereof to at least partially melt and become adhered to the photoconductor binder member copy or copy substrate in the case of images transferred from the imaging media, followed by the application of pressure to the toner with heating such as the use of a heated roller. Solvent or solvent vapor fusing has also been used, wherein the resin component of the toner is partially dissolved. The photoconductor binder member or copy substrate is typically of sufficient hardness to allow fixing solely by the application of pressure such as for example by a contact roller and in an amount sufficient to calender the toner. With some existing toner materials images are fixed using a heat pressure fusing system at surface speeds of up to 20 inches per second but recently it has been found desirable to achieve fixing speeds up to at least 50 inches per second and special toner materials are needed in order to effect such high fixing speeds particularly in magnetic systems where the high magnetic pigment loading required for development can have an adverse effect on the desired fusing level of the toner.

Concurrently with the growth of interest in magnetic imaging there has been increased interest in magnetic developers to render the latent magnetic images visible. In U.S. Pat. No. 3,221,315 there is described the use of encapsulated ferrofluids in a magnetic recording medium, wherein the ferrofluid orientation in the presence of a magnetic field exhibits a variable light responsive characteristic. In this situation the magnetic recording medium is self-developing in the sense that magnetic marking material need not be employed to render a visible image. In other situations latent magnetic images are rendered visible by magnetic marking material. Thus, for example, in U.S. Pat. No. 3,627,682 there is disclosed binary toners for developing latent magnetic images, which binary toners include a particulate hard magnetic material and a particulate soft magnetic material in each toner particle. The toner particles include two materials in a binder material. In U.S. Pat. No. 2,826,634 there is described the use of iron or iron oxide particles either alone or encapsulated in low melting resin or binders for developing latent magnetic images. Low optical density and relative unresponsiveness to weak magnetic fields are exhibited by relatively large iron or iron oxide base magnetic particles.

Other patents evidencing the continuing interest in improved magnetic developers include U.S. Pat. No. 3,520,811, which discloses that magnetic particles of chromium dioxide appear to catalyze surface polymerization of organic air drying film forming vehicles such as those employed in oil base materials in order that a coating of polymerized vehicle is formed around the particle; and U.S. Pat. No. 3,905,841 which teaches the prevention of agglomeration and the formation of homogeneous dispersions of cobalt-phosphorous particles into an organic resin binder by treatment with a solution containing sulfuric acid.

SUMMARY OF THE INVENTION

It is an object of the present invention to provide new toners which have utility in various imaging systems.

A further object of the present invention is the provision of new toners useful in magnetic imaging systems.

Another object of the present invention is the provision of new toners useful in high speed fusing systems.

A further object of the present invention is the provision of new magnetic toners containing relatively high loadings of magnetite materials, which toners are useful in magnetographic systems, especially magnetographic duplication systems.

These and other objects of the present invention are accomplished by providing new electrophotographic and magnetic toners which are particularly useful in heat pressure fusion and high speed fusing systems which toners are comprised of a polyamide resin, a pigment or colorant, which pigment or colorant may be magnetic and as an optional ingredient a carrier material. More specifically, the toner of the present invention is comprised of a pigment and a polyamide resin of the following formula:

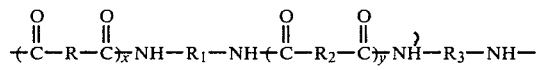

wherein R, $R_1$, $R_2$, and $R_3$ are radicals independently selected from aliphatic, substituted aliphatic, aromatic, substituted aromatic, cycloaliphatic, and heterocyclic, x is a number of from 1 to about 100, and y is a number of from 1 to about 100. Preferably x and y are numbers of from 10 to about 35.

In the preferred embodiment of the present invention the polyamide resin is used together with magnetic materials for employment in magnetic development systems. When used in such systems, especially when high speed fusing is desired, for example speeds of from about 20 inches per second, to about 50 inches per second, and preferably from about 35 inches per second to about 50 inches per second, it is preferred that at least about 50 percent of magnetic material is present.

Illustrative examples of aliphatic radicals include those containing from 1 to about 30 carbon atoms such as alkyl, alkenyl and alkynal, with alkyl being preferred. Specific examples of such radicals include methyl, ethyl, propyl, butyl, isobutyl, pentyl, hexyl, heptyl, octyl, decyl, tridecyl, eicosyl, tricontyl, ethylenyl, propylenyl, butylenyl, pentylenyl, hexylenyl, octylenyl, decenyl, tetradecenyl, ethynyl, methynyl, butynyl, pentynyl, isopentynyl, heptynyl, octanonyl and the like. Examples of aromatic radicals would include those containing from 6 to about 24 carbon atoms such as phenyl, benzyl, styryl, and the like, with phenyl being preferred. Examples of cycloaliphatic and heterocyclic radicals include cyclopentyl, cyclohexyl, cycloheptyl, cycloctyl and furanyl, thiophenyl, pyridinyl, pyrryl, and the like.

These radicals can be substituted with various substituents including for example, alkyl as defined herein, halogens, with chlorine being preferred, nitrogen, oxygen, sulphur containing materials, and the like.

It is not intended that the scope of the present invention be limited to the above defined radicals, the specific radicals are being listed for illustration purposes only and numerous types of other radicals not specifically listed are intended to be included within the scope of the present invention.

In the above formula the end groups of the polyamide chain would typically be terminated, such termination being effected by the addition of a hydrogen atom on the amine end of the formula, and the addition of an OH radical on the carboxyl of the formula, thereby resulting in an $NH_2$ and COOH termination respectively.

Other preferred polyamide resins suitable for use in the present invention, and embraced within the above-identified formula include those where the radicals $R_1$ and $R_3$ are an ethylenic group such as [—CH=CH—], including those made from ethylene diamine/hexamethylene diamine; and dimer acid materials such as those of the following formula:

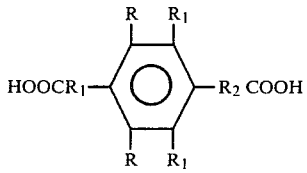

wherein R, $R_1$, and $R_2$ are as defined herein. The ring between the two chains can either be a 6 membered ring as shown, or a 5 membered ring; and there are generally 6 to 12 carbon atoms between the two carboxyl groups. The total number of carbon atoms is generally about 36.

Some of the preferred polyamide resins embraced within the scope of the present invention are commercially available materials from Emery Industries, Inc., these resins being identified as Emerez® Polyamide Resins, including Emerez 1552A, 1540, 1565, and other similar materials as disclosed in Emery Industries Inc. Technical Bulletin 107, 1977, totally incorporated herein by reference.

Other polyamide resins embraced within the present invention include Versamid® resins, commercially available from General Mills, Chemical Division. These include Versamid® 930, 940, 950 and other similar materials as disclosed in various Technical Service Department Bulletins of General Mills, Chemical Division, (1977), incorporated herein by reference.

Any suitable colorant or pigment may be used together with the polyamide resin. These materials include but are not limited to carbon black, the preferred colorant, nigrosine dye, aniline blue, chalco blue, chrome yellow, ultramarine blue, (DuPont Oil Red®), methylene blue chloride, phthalocyanine blue and mixtures thereof. The pigment should be present in the toner in sufficient quantity to render it highly colored so that it will form a clearly visible image on the recording member. For example where conventional xerographic copies of documents are desired the toner may comprise a black pigment such as carbon black or a black dye such as Amaplast Black Dye available fron National Aniline Products Inc. Preferably the pigment is employed in amounts from about 3 percent to about 20 percent by weight based on the total weight of toner, however, if the toner colorant employed is a dye substantially smaller quantities of the colorant may be used. The amount of polyamide resin used in this formulation would range from about 80 percent to about 97 percent.

When the toner of the present invention is used in a magnetic development system virtually any magnetic substance can be used together with the polyamide resin including for example: suitable metals such as iron, cobalt, nickel; various magnetic iron oxides, including $Fe_2O_3$, $Fe_3O_4$, and various other forms of magnetite, for example, Mapico Black; certain ferrites such as zinc, cadmium, barium, manganese; chromium dioxide; various of the permalloys and other alloys such as cobalt-phosphorus, cobalt-nickel and the like; or mixtures of any of these. Other magnetic materials are embraced within the present invention, and it is not intended to be limited to those mentioned as illustrative examples. Also any suitable pigment or colorant, as defined herein, can be included in the magnetic toner composition, thus such a composition would be comprised of a polyamide resin, a magnetic material, and a pigment or colorant. The amount of pigment or colorant present depends primarily on the amount of magnetic material present. Generally, however, about 1 percent to about 10 percent by weight of pigment or colorant is present. The amount of the three materials, that is, toner resin, pigment or colorant, and magnetic material should total 100 percent.

The amount of magnetic pigment material present ranges from about 40 percent to about 90 percent by weight, and preferably from about 50 percent to about 75 percent, in order to achieve adequate development and fusing at high speed, that is, approaching 35 to 50 inches per second, in a preferred embodiment. In such formulations the amount of polyamide resin used ranges from about 60 percent to about 10 percent, and preferably from about 50 percent to about 25 percent.

In electrophotographic systems any suitable carrier material can be employed when the tone of the present invention is used in a conventional xerographic imaging system as long as such particles are capable of triboelectrically obtaining a charge of opposite polarity to that of the toner particles. Thus for example the carriers can be selected so that the toner particles acquire a charge of positive polarity and include such materials as sodium chloride, ammonium chloride, ammonium potassium chloride, Rochelle salt, sodium nitrate, aluminum nitrate, potassium chlorate, granular zircon, granular silcon, glass, steel, nickel, iron ferrites, silicon dioxide and the like. The carriers can be used with or without a coating. Coatings including fluorocarbon materials such as polyvinyl fluoride and vinylidene fluoride resins and the like may be used. Nickel berry carriers are also useful, these carriers being described in U.S. Pat. Nos. 3,847,604 and 3,767,598. Carrier particles of various diameters can be used, including those having a diameter of from about 50 to about 500 microns, thus allowing the carrier to possess sufficient density and inertia to avoid adherence to the electrostatic images during the developement process. This carrier can be employed with the toner compositions in any suitable combination, however, best results are obtained when about 1 part per toner is used, and about 10 to about 200 parts per weight of carrier.

The toners used in the present invention can, be prepared by various known methods, such as spray drying. In the spray drying method the appropriate polymer is dissolved in an organic solvent or solvent mixture like hexane-chloroform. The toner colorant and/or pigments are also added to the solvent. Vigorous agitation, such as that obtained by ball milling processes assists in insuring good dispersion of the colorant or pigment. This solution is then pumped through an atomizing nozzle while using an inert gas such as nitrogen, as the stomizing agent. The solvent evaporates during atomization, resulting in toner particles of a pigmented resin. Particle size of the resulting toner varies depending on the size of the nozzle, however, particles of a diameter between about 0.1 micrometers and about 100 micrometers generally are obrained. Melt blending or dispersion processes can also be used preparing the toner compositions of the present invention. This involves melting a powdered form of an appropriate polymeric resin and mixing it with suitable colorants and/or pigments. The resin can be melted by heated rolls, which rollers can be used to stir and blend the resin. After thorough blending the mixture is cooled and solidified. The solid mass that results is broken into small pieces and subsquently finely ground so as to form free flowing toner particles, which range in size of from 0.1 to about 100 microns.

Other methods for preparing the toners of the present invention include dispersion polymerization, emulsion polymerization and melt blending/cryogenic grinding.

DESCRIPTION OF PREFERRED EMBODIMENTS

The following examples further define and describe the toner compositions of the present invention and methods for preparing such toner compositions, parts and percentages being by weight unless otherwise indicated.

Fusing results obtained using various magnetic toners are outlined in the following table. The data shown was obtained employing a modified heated pressure roll fuser assembly operated at about 390° F. and with a 0.65" nip pressure-to-fuser roll setting. Image permanence was determined by resistance to abrasion using a standard Taber abraser. The abrasion resistance was judged by reduction in optical density at a solid area patch of fixed toner. Quantification of the image permanence was determined by the number of abrasion cycles used to cause a fixed reduction in optical density, which reduction was due to wear and removal of the fixed toner. Generally, the greater the number of cycles to fixed reduction in optical density, the better the fix. A minimum of about 10 Tabor cycles has been demonstrated to correspond to acceptable fix for the optical density reduction criteria used.

Referring to the Table at a process speed of 50 inches/second, in the row titled Magnetic Pigment Loading (Wt. Percent) excellent fixing was obtained as shown by the numbers 34, 48, and 35 while poor fixing was obtained, as shown by the numbers 4, 3, and 3, at a process speed of 50 inches/second, reference the row titled, $Fe_3O_4$ under Styrene-n-Butyl Methacrylate Copolymer. Similar comparative results are shown for other materials at process speeds of 20, 35, and preferably 50 inches per second. The numbers given in the Table represent the number of Taber Abraser Cycles required to reduce the original density of the image by a selective fixed percentage such as 20 percent. The Taber Abraser provides a generally accepted method for the determination of image fix level for fused toner images.

TABLE OF FUSING RESULTS FOR VARIOUS MAGNETIC TONERS
(Given as Number of Taber Cycles to 20% Reduction In Image Density

| Process Speed (In/Sec) | 20 | 35 | 50 |
|---|---|---|---|
| Magnetic Pigment→ | | | |

-continued

TABLE OF FUSING RESULTS FOR VARIOUS MAGNETIC TONERS (Given as Number of Taber Cycles to 20% Reduction In Image Density

| Process Speed (In/Sec) | 20 | | | 35 | | | 50 | | |
|---|---|---|---|---|---|---|---|---|---|
| Loading (Wt. Percent) | 55 | 65 | 75 | 55 | 65 | 75 | 55 | 65 | 75 |
| Resin and Magnetic ↓ Pigment Type | | | | | | | | | |
| Emerez 1552 Polyamide Resin | | | | | | | | | |
| $Fe_3O_4$ | 40 | 42 | 50 | 32 | 44 | 50 | 34 | 48 | 35 |
| Fe: $Fe_3O_4$ (50:50) | 30 | 32 | 25 | 30 | 26 | 37 | 28 | 33 | 39 |
| Fe: C (95:5) | 23 | 26 | 43 | 18 | 35 | 47 | 25 | 40 | 30 |
| Styrene-n-Butyl Methacrylate Copolymer | | | | | | | | | |
| $Fe_3O_4$ | 36 | 35 | 23 | 5 | 9 | 7 | 4 | 3 | 3 |
| Fe: $Fe_3O_4$ (50:50) | 30 | 27 | 30 | 16 | 14 | 10 | 6 | 3 | 4.5 |
| Fe: C (95:5) | 40 | 39 | 43 | 12 | 29 | 8 | 7 | 6 | 4 |
| Propoxylated Bisphenol Fumarate Resin | | | | | | | | | |
| $Fe_3O_4$ | 30 | 12 | 26 | 15 | 10 | 12 | 5 | 3 | 7 |

EXAMPLE I

A toner consisting of 35 parts by weight of the polyamide resin Emerez 1552, commercially available from Emery Industries, Inc., and 65 parts by weight of the magnetite, Mapico Black, commercially available from Columbian Chem. Div. of Cities Service Co., was prepared by conventional spray drying techniques from a mixture of hexane-chloroform. The resulting material was then dry blended with about 1 percent by weight of a flow agent additive, Tullanox 500, commercially available from Tulco, Inc., and subsequently size-classified to obtain a black magnetic toner having a volume average particle size of about 8–15 um, (microns).

This toner, when used in a magnetic imaging system for developing magnetic images, produced images of uniform, high optical density and excellent resolution.

EXAMPLE II

A toner was prepared in accordance with Example I, with the exception that the magnetic pigment used was a magnetite, MO-4431 commercially available from Pigments Div. of Pfizer Corporation, instead of Mapico Black, and substantially similar results were obtained when such a toner was used for developing a magnetic image.

EXAMPLE III

The procedure of Example II was repeated with the exception that the polamide resin Emerez 1565, commercially available from Emery Industries, Inc., was used, and substantially similar results were obtained when such a toner was used for developing a magnetic image. Excellent fixing of the image was noted at a machine process speed of 50 inches per second.

EXAMPLE IV

The procedure of Example II was repeated with the exception that the polamide resin Emerez 1540, commercially available from Emery Industries, Inc., was used, and substantially similar results were obtained when such a toner was used for developing a magnetic image.

EXAMPLE V

The procedure of Example I was repeated with the exception that an iron oxide ($Fe_2O_3.Fe_3O_4$) was used in place of the magnetite, and substantially similar results were obtained when such a toner was used for developing a magnetic image.

Example VI

The procedure of Example I was repeated with the exception that 25 parts by weight of the polyamide resin, and 75 parts by weight of the magnetite were used.

This toner, when used in a magnetic imaging system for developing magnetic images, produced images of uniform, high optical density and excellent resolution.

EXAMPLE VII

The procedure of Example I was repeated with the exception that a toner consisting of 25 parts by weight Emerez 1552 polyamide resin, 25 parts by weight of a propoxylated bisphenol fumarate resin and 50 parts by weight of K-378 magnetite, commercially available from Northern Pigments Ltd., was prepared by spray drying. This toner was subsequently dry blended with about 10 percent by weight of a conductive carbon black to create an electroscopic imaging powder. One part by weight of this toner was mixed with 100 parts by weight of a steel carrier, in a steel container with a stirring mechanism, resulting in the formation of a developer material.

The resulting developer was employed in a xerographic imaging device for the purpose of developing a latent electrostatic image. Copies of high quality and excellent resolution were obtained.

In one important preferred embodiment of the present invention, when the toner is used in a magentic imaging system, the magnetic substance has a polyhedral (multisided) shape, one such polyhedral substance being for example Mapico Black, reference working Example I.

The toners of the present invention can be used to develop electrophotographic or magnetic images employing imaging systems such as those described herein, and as illustrated for example beginning on Page 1.

Other modifications of the present invention will occur to those skilled in the art based upon a reading of the present application and these are intended to be included within the scope of this invention.

What is claimed is:

1. A method for developing electrostatographic images by causing the formation of an electrostatic latent image on a photoreceptor surface, followed by contacting the latent image with a developer composition comprised of an improved toner, and a carrier material, said improved toner consisting of a colorant, or pigment, and a polyamide resin of the formula:

$$\left(C-R-\overset{O}{\overset{\|}{C}}\right)_x-NH-R_1-NH\left(C-R_2-\overset{O}{\overset{\|}{C}}\right)_y-NH-R_2NH-$$

wherein R, $R_1$, $R_2$, and $R_3$ are independently selected from aliphatic radicals containing from about 1 to about 30 carbon atoms, aromatic radicals containing from 6 to about 24 carbon atoms and x is a number of from about 10 to about 35, y is a number of from about 10 to about 35, followed by transferring the developed image to a substrate and fusing the image to said substrate wherein fusing is accomplished at a rate of between about 20 inches per second to about 50 inches per second.

2. An improved method for developing magnetic latent images by causing the formation of a magentic latent image on a suitable substrate, followed by contacting the image with a developer composition comprised of an improved magnetic toner and a carrier material, said improved toner consisting of a magnetic material and a polyamide resin of the formula $$\left(\overset{O}{\overset{\|}{C}}-R-\overset{O}{\overset{\|}{C}}\right)_x NH-R_1NH\left(\overset{O}{\overset{\|}{C}}-R_2-\overset{O}{\overset{\|}{C}}\right)_y NH-R_3NH-$$

wherein R, $R_1$, $R_2$, and $R_3$, are independently selected from aliphatic radicals containing from about 1 to about 30 carbon atoms, aromatic radicals containing from 6 to about 24 carbon atoms, and x is a number of from about 10 to about 35, y is a number of from about 10 to about 35, followed by transferring the developed image to a substrate, and fusing the image to said substrate wherein fusing is accomplished at a rate of between about 20 inches per second to about 50 inches per second.

* * * * *